United States Patent [19]

Nelson

[11] 4,314,113

[45] Feb. 2, 1982

[54] KEYSWITCH HAVING CONTACTS MOUNTED ON CANTILEVER BEAMS

[75] Inventor: Edward I. Nelson, Sunrise, Fla.

[73] Assignee: Burroughs Corporation, Detroit, Mich.

[21] Appl. No.: 113,907

[22] Filed: Jan. 21, 1980

[51] Int. Cl.[3] ..... H01H 3/12

[52] U.S. Cl. ..... 200/5 R; 200/159 A; 200/283; 200/340

[58] Field of Search ..... 200/5 R, 5 A, 5 B, 5 C, 200/5 D, 5 E, 5 EA, 5 EB, 5 EF, 159 R, 159 A, 159 B, 340, 283

[56] References Cited

U.S. PATENT DOCUMENTS 4,063,054 12/1977 Hirata ..... 200/159 R

FOREIGN PATENT DOCUMENTS 1437172 5/1976 United Kingdom ..... 200/159 A

*Primary Examiner*—J. V. Truhe
*Assistant Examiner*—Morris Ginsburg
*Attorney, Agent, or Firm*—James E. Ledbetter; David G. Rasmussen; Kevin R. Peterson

[57] ABSTRACT

A keyswitch comprising a housing, a plunger which slides in a channel in the housing, a pair of crossed, opposing cantilever beams which have their fixed ends attached to the housing floor and which with their free ends make springing contact with the plunger, and a pair of electrical contacts each of which is attached to a respective cantilever beam. The keyswitch may also include a cam element to achieve switching and a third contact element to create a bounceless switch.

5 Claims, 6 Drawing Figures

KEYSWITCH HAVING CONTACTS MOUNTED ON CANTILEVER BEAMS

BACKGROUND OF THE INVENTION

1. Field of the Invention

This invention relates to an improved keyswitch for use in typewriters, electronic calculators or the like.

2. Description of the Prior Art

In conventional keyswitch assemblies, contact between the electrical contact elements has been achieved through some means which applies direct force on one or both of the contacts to bring them together. In such devices the amount of contact force on the electrical contacts is directly proportional to the amount of pressure applied to the keytop; hence, the devices require a heavy touch by the operator in order to achieve a sufficiently great contact force. Two examples of conventional switching devices are found in U.S. Pat. No. 4,017,700 and U.S. Pat. No. 3,849,611. Also, in conventional switch assemblies, complex electronic circuitry is required in order to overcome the problem of bouncing of the contacts.

SUMMARY OF THE INVENTION

This invention is concerned with a keyswitch mechanism which, unlike the traditional devices described above, requires only a very light touch by the operator to achieve switching and which, at the same time, provides high contact forces between the electrical contacts. This is accomplished by placing the contacts on opposing, crossed cantilever beams such that when the beams are in their normal unflexed condition, the contacts are in their closed circuit condition. A finger-operated plunger engages with the free ends of the cantilever beams, and when the plunger is depressed, a deflecting force is exerted through the plunger arms on the free ends of the cantilever beams, pushing both beams downwardly. This downward motion of the cantilever beams causes the two contacts to pull apart, thus creating an open switch condition. The spring force stored in the deflected cantilever beams returns the beams and the depressed plunger to their normal rest position after the operator removes the pressure from the plunger. In two of the disclosed embodiments, a cam element is provided for achieving switching of the contacts. In addition, by adding a third contact, a bounceless switch is provided. The third contact is disposed such that contact is made between it and one of the cantilever beams at the bottom of the deflection cycle after the primary contact has been broken. The signal resulting from closing the secondary contact may be used to indicate to associated equipment that the primary contact has been broken.

It is an object of the invention to provide a keyswitch which requires only a very light touch by the operator to achieve switching and which at the same time provides high contact forces between the electrical contacts.

It is another object of the invention to provide a keyswitch having contacts mounted on cantilever beams.

It is another object of the invention to provide a keyswitch having cam means for switchably operating the electrical contacts.

It is still another object of the invention to provide a bounceless keyswitch having a contact mounted on each of two cantilever beams and a third contact disposed adjacent to one of said cantilever beams such that contact will be made between one of said cantilever beans and said third contact when said cantilever beams are deflected.

BRIEF DESCRIPTION OF THE DRAWINGS

The objects, advantages and features of this invention will be more clearly appreciated from the following detailed description when taken in conjunction with the accompanying drawings in which.

DETAILED DESCRIPTION OF THE PREFERRED EMBODIMENTS

Figure 1:
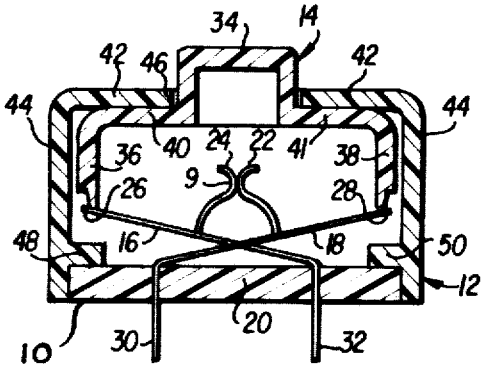
FIG. 1 shows a cross-sectional view of one embodiment of the switch of this invention.

In FIG. 1 a keyboard switch 10 is shown in which housing 12 has a plunger 14 which is guided within said housing 12, and a pair of electrical contact elements, 16 and 18, rigidly attached to the housing base 20. The electrical contact elements 16 and 18 have: (a) projections 30 and 32 which are pressed through the base 20 to make contact or connection to external circuitry such as a printed circuit board, not shown in the drawing; (b) cantilever beams, 26 and 28 which serve to return the plunger 14 to the normal rest position after the key is released; (c) contact fingers 22 and 24, which are attached to the approximate mid point of the cantilever beam section 26 and 28.

In operation the contacts 16 and 18 may be assembled into a housing base 20 in a crossed cantilever arrangement, in such a fashion and spacing that contact fingers 22 and 24 are pressed tightly against each other when the cantilever beam portion of the contacts 26 and 28 are in their normal unflexed position as shown in FIG. 1. In the embodiment shown in FIG. 1, each contact finger forms an approximately S-shaped curve so as to provide a good electrical contact at contact point 9 which may be gold plated for improved electrical conductance.

Figure 6:
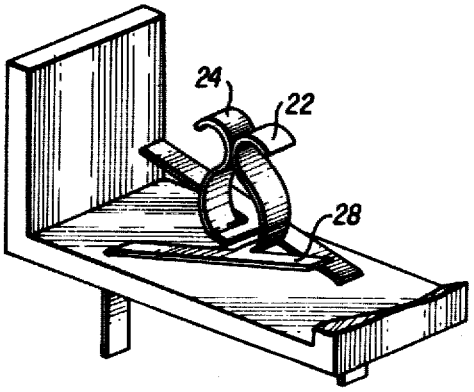
FIG. 6 shows a perspective view of the electrical contacts of FIGS. 1 and 5.

The cantilever beams 26 and 28 are securely attached to the base 20 of switch 10 and are angled at approximately 30° from the housing base 20. The beams 26 and 28 cross a small distance apart at approximately their mid-sections as shown in FIG. 6. The electrical contacts fingers 22 and 24 are each attached to a respective cantilever beam 26 or 28 just above this crossing point. The fingers 22 and 24 may be attached in that they are an integral part of the beams 26 and 28 or they may be attached through soldering or other means.

The plunger 14 shown in FIG. 1 comprises a key cap 34 which fits into a key top, not shown, to provide a push-button assembly. The key top fits into one of a plurality of holes in the keyboard, also not shown in the drawings. The plunger 14 also includes two arms 36 and 38 which make contact with the free ends of the cantilever beams 26 and 28. In FIG. 1 the keyswitch is in its normal rest position and the shoulders 40 and 41 of the plunger make contact with the ceiling 42 of the housing 12. The plunger arms 36 and 38 make sliding contact with the walls 44 of housing 12, and the key cap 34 extends through opening 46 in the ceiling 42 of the housing 12.

Figure 2:
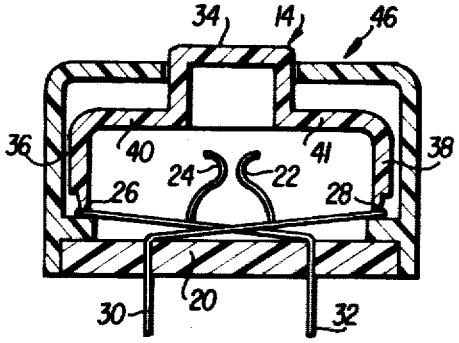
FIG. 2 is a partial expanded cross-sectional view similar to FIG. 1, showing the plunger and cantilever beams in their fully deflected positions.

In operation, the keyswitch works as follows. As the plunger 14 is pushed downwardly, force is exerted through the plunger arms 36 and 38 on the free ends of each beam causing the free ends to be pushed downwardly. This rotational motion of the cantilever beams 26 and 28 causes the two electrical contacts 22 and 24 to separate, thereby creating a switch opening as depicted in FIG. 2. In FIG. 2, the keyswitch 46 is shown with the plunger 14 fully depressed, the cantilever beams 26 and 28 fully deflected, and the electrical contacts 22 and 24 in the open condition. Two pads 48 and 50 serve to stop the downward motion of the beams 26 and 28 and to supply a "touch" indication to the operator that the switch has been fully depressed. When pressure is removed from the plunger 14, the plunger is returned to its rest position by the spring force stored in the deflected cantilever beams 26 and 28, and contacts 22 and 24 are returned to their normally closed condition.

Figure 3:
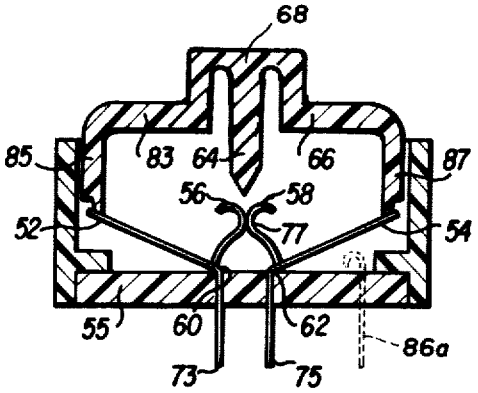
FIG. 3 is a cross-sectional view similar to FIG. 2 showing the addition of a cam opening switch element.

FIG. 3 shows an embodiment of the invention similar to that shown in FIGS. 1 and 2. In the FIG. 3 embodiment, the cantilever beams 52 and 54, are not crossed, but instead, the free ends of the beams point away from one another. Also, in FIG. 3 the electrical contacts 56 and 58 are closed when the beams 52 and 54 are in their unflexed position and are attached to the beams at the lower curved portions 60 and 62 of the cantilver beams 52 and 54. A cam 64 extends from the bottom surface 66 of the center of the plunger 68. The operation of the FIG. 3 embodiment is similar to that of the FIG. 1 embodiment except that as the plunger 68 is depressed, the cam 64 is moved between the contacts 56 and 58 to assure separation thereof.

Figure 4:
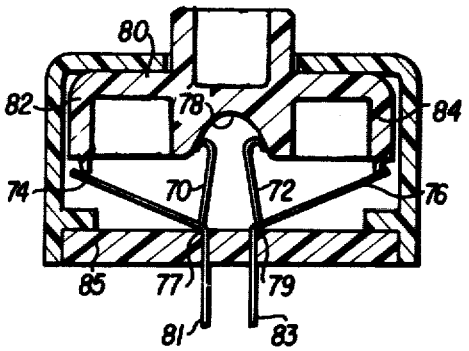
FIG. 4 shows a cross-sectional view of a second embodiment of the switch of this invention. (Cam closing switch element.)

In FIG. 4 an embodiment is depicted which is similar to that shown in FIG. 3 except that the electrical contacts 70 and 72 are in the open condition when the beams 74 and 76 are unflexed and the cam surface 78 operates to close the contacts 70 and 72. The contacts are attached to the arced portions 77 and 79 of the cantilever beams 74 and 76 and are curved on their ends so they can easily follow the cam surfce 78. The cam surface is cut concavely into the lower surface of the plunger 80. In operation, as the plunger 80 is depressed the plunger arms 82 and 84 push the free ends of the cantilever beams 74 and 76 downwardly. Eventually the cam surface 78 makes contact with the curved ends of contacts 70 and 72 and guides the contacts together until a closed circuit condition exists.

Figure 5:
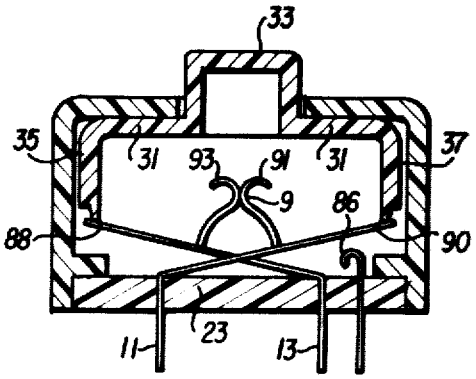
FIG. 5 shows a cross-sectional view of a third embodiment of the switch of this invention having a third contact element.

In FIG. 5 an embodiment is depicted in which a third electrical contact 86 has been provided such that the switching device becomes a single pole double throw switch. This switch operates as follows. When the plunger is depressed and the cantilever beams 88 and 90 are correspondingly deflected, cantilever beam 90 makes contact with the third contact element 86. The downward motion of the cantilever beams causes the primary electrical contact between contacts 91 and 93 to break and the secondary electrical contact between beam 90 and contact 86 to close. The short time delay between breaking the primary circuit and closing the secondary circuit provides the equivalent of a bounceless switch when the signal from the secondary circuit is used to indicate to associated circuitry that a switch opening has occurred on the primary contact. Thus, the third contact avoids the problem of a misinterpreted switch opening that would occur if the first two electrical contacts were to bounce when they are returned by the cantilever spring to their closed contact position. A third contact 86*a* could be provided as shown in FIG. 3 or in FIG. 4 (not shown) to provide alternative embodiments of this bounceless switch feature.

Many obvious modifications and variations of the present invention are possible in light of the above teachings. It is therefore to be understood that within the scope of the appended claims the invention may be practiced otherwise than as specifically described.

What is claimed is:

1. A keyswitch, comprising:

a housing;

a plunger which is guided within said housing;

a pair of cantilever beams attached to said housing, said beams making springing contact with said plunger whereby putting pressure on said plunger results in deflection of said cantilever beams and removing pressure from said plunger causes said beams and said plunger to springably return to their rest positions; and a pair of electrical contacts each attached to a respective cantilever beam such that when said beams are in their rest position said contacts touch one another and when said beams are deflected said contacts do not touch one another.

2. The keyswitch of claim 1 wherein said cantilever beams are in opposed relationship and wherein said keyswitch further comprises a third electrical contact disposed adjacent to one of said cantilever beams such that contact will be made between said third contact and said adjacent one of said cantilever beams when said beam is deflected to approximately its fully deflected position.

3. The keyswitch of claim 1 wherein said cantilever beams are in unopposed relationship and wherein said keyswitch further comprises a third eletrical contact disposed adjacent to one of said cantilever beams such that contact will be made between said third contact and said adjacent one of said cantilever beams when said beam is deflected to approximately its fully deflected position.

4. The keyswitch of claim 1 wherein said cantilever beams are in opposed crossed relationship and wherein said key switch further comprises a third electrical contact disposed adjacent to one of said cantilever beams such that contact will be made between said third contact and said adjacent one of said cantilever beams when said beam is deflected to approximately its fully deflected position.

5. A keyswitch comprising:

a housing;

a plunger which is guided within said housing;

a pair of opposed, crossed cantilever beams attached to said housing, said beams making springing contact with said plunger whereby putting pressure on said plunger causes deflection of said cantilever beams and removing pressure from said plunger causes said beams and said plunger to springably return to their rest positions;

a pair of electrical contacts each attached to a respective cantilever beam such that deflection of said beams causes the contacts to be switchably operated; and a third electrical contact disposed adjacent to one of said cantilever beams such that contact will be made between said third contact and said adjacent one of said cantilever beams when said beam is deflected to approximately it fully deflected position.

* * * * *